US005725744A

United States Patent [19]

de Nora et al.

[11] Patent Number: 5,725,744

[45] Date of Patent: Mar. 10, 1998

[54] CELL FOR THE ELECTROLYSIS OF ALUMINA AT LOW TEMPERATURES

[75] Inventors: Vittorio de Nora, Sandrigham House, Bahamas; Jean-Jacques Duruz, Geneva, Switzerland

[73] Assignee: Moltech Invent S.A., Luxembourg

[21] Appl. No.: 636,895

[22] PCT Filed: Nov. 19, 1992

[86] PCT No.: PCT/EP92/02666

§ 371 Date: Sep. 26, 1994

§ 102(e) Date: Sep. 26, 1994

[87] PCT Pub. No.: WO93/10281

PCT Pub. Date: May 27, 1993

Related U.S. Application Data

[63] Continuation of Ser. No. 244,250, Sep. 26, 1994, abandoned.

[30] Foreign Application Priority Data

Mar. 24, 1992 [AT] Austria ..... 92810212

[51] Int. Cl.[6] ..... C25C 3/08; C25C 3/14

[52] U.S. Cl. ..... 204/244; 204/245; 204/247

[58] Field of Search ..... 204/244, 243 R, 204/245; 205/376; C25C 3/08

[56] References Cited

U.S. PATENT DOCUMENTS

| | | | |
|---|---|---|---|
| 3,893,899 | 7/1975 | Dell et al. | 204/244 |
| 3,951,763 | 4/1976 | Sleppy et al. | 204/67 |
| 4,110,178 | 8/1978 | LaCamera et al. | 204/64 R |
| 4,151,061 | 4/1979 | Ishikawa et al. | 204/247 |
| 4,402,808 | 9/1983 | McMonigle | 204/247 |
| 4,405,433 | 9/1983 | Payne | 204/225 |
| 4,504,366 | 3/1985 | Jarrett et al. | 204/243 R |
| 4,681,671 | 7/1987 | Duruz | 204/67 |
| 4,865,701 | 9/1989 | Beck et al. | 204/67 |
| 4,960,494 | 10/1990 | Nguyen et al. | 204/67 |
| 5,006,209 | 4/1991 | Beck et al. | 204/67 |
| 5,015,343 | 5/1991 | LaCamera et al. | 204/67 |
| 5,286,359 | 2/1994 | Richards et al. | 204/244 X |
| 5,362,366 | 11/1994 | de Nora et al. | 204/67 |
| 5,368,702 | 11/1994 | de Nora | 204/247 X |
| 5,415,742 | 5/1995 | LaCamera et al. | 204/244 |

FOREIGN PATENT DOCUMENTS

| | | |
|---|---|---|
| 0126555 | 11/1984 | European Pat. Off. . |
| 0192602 | 8/1986 | European Pat. Off. . |

*Primary Examiner*—Donald R. Valentine
*Attorney, Agent, or Firm*—Dinsmore & Shohl, LLP

[57] ABSTRACT

An electrolysis cell for the production of aluminum by the electrolysis of alumina dissolved in a molten halide electrolyte using a multimonopolar arrangement of substantially non-consumable anodes and cathodes with facing operative surfaces which are upright or at a slope and are spaced in a substantially parallel relationship, enabling operation at low and/or current density with an acceptable production per unit self-lowered area. The operative surface area of the anodes and the cathodes is high due to their upright sloping configuration. Operative surfaces of the anodes and possibly of the cathodes can be increased by making them porous, preferably with their articulated skeletal structure, e.g. with a porous active part on opposite faces of a central current feeder. There is an upward circulation of electrolyte by gas lift between the electrodes, such circulation being enhanced by electrolyte circulation guide means provides by members of electrically non-conducting material arranged outside the spacing between the anodes and the cathodes.

21 Claims, 3 Drawing Sheets

CELL FOR THE ELECTROLYSIS OF ALUMINA AT LOW TEMPERATURES

This is a continuation, of application Ser. No. 08/244,250, filed Sep. 26, 1994 now abandoned.

TECHNICAL FIELD

The invention relates to a cell for producing aluminum by electrolysis of alumina dissolved in a molten halide electrolyte particularly at temperatures between 680°–880° C.

BACKGROUND OF THE INVENTION

Aluminium is produced by the Hall-Héroult process which involves the electrolysis of alumina dissolved in molten cryolite ($Na_3AlF_6$) at about 960° C. using carbon anodes which are consumed with the evolution of $CO_2$. However, the process suffers from major disadvantages. The high cell temperature is necessary to increase the solubility of alumina and its rate of dissolution so that sufficient alumina can be maintained in solution, but requires heavy expenditure of energy. At the high cell temperature, the electrolyte and the molten aluminium aggressively react with most materials including ceramic and carbonaceous materials, and this creates problems of containment and cell design. The anode-cathode distance is critical and has to be maintained high due to the irregular movement of the molten aluminium cathode pool, and this leads to loss of energy. Since the anodes are continually being consumed, this creates problems of process control. Further, the back oxidation of Al to $Al^{3+}$ decreases the current efficiency.

Potentially, the electrolysis of alumina at low temperatures (below 880° C.) in halide melts has several distinct advantages over the conventional Hall-Héroult process operating at about 960° C. As shown by bench-scale tests, electrolysis at reduced current densities in low temperature melts potentially offers a significant advantage in increasing the stability of electrode materials, but it has not yet proven possible to implement the process in a way where this advantage could be realized in larger scale cells and in commercial cells. Other potential advantages are higher current and energy efficiencies and the possibility of designing a completely enclosed electrolytic cell.

Problems which hindered the practicability of low temperature electrolysis are the low alumina solubility in low temperature electrolytes, as well as low alumina solution rates. Under these conditions, a sufficiently high transport rate of oxide ion species from the bulk of the electrolyte to the anode surface cannot be maintained at the anode current densities normally used in conventional Hall-Héroult cells. The configuration of cells presently used does not permit a substantial increase of the relative surface area of anode to cathode. This means that a reduction of the current density would lead directly to a reduction of the cell productivity. Moreover, the design of presently used cells does not enable an increase of the electrolyte circulation to increase the transport rate of oxygen ions to the anode active surface area and to increase the dissolution rate of alumina in the electrolyte.

Low temperature alumina electrolysis has been described in U.S. Pat. No. 3,951,763 and requires numerous expedients such as the use of a special grade of water-containing alumina to protect the carbon anodes, and the bath temperature had to be 40° C. or more above the liquidus temperature of the $Na_3AlF_6/AlF_3$ system in an attempt to avoid crust formation on the cathode. In practice, however, the carbon anodes were severely attacked during anode effects accompanied by excessive $CF_4$ emissions. Crusts also formed on the cathode up to electrolyte temperatures of 930° C.

Because of the difficulties encountered with fluoride-based melts, major efforts to secure the advantages of low temperature electrolysis were devoted to different electrolytes, notably chloride based electrolytes where $AlCl_3$ is used as a feed; the anode reaction being chlorine evolution. See e.g. K. Grjotheim, C. Krohn and H. ϕye, Aluminium 51, No 11, 1975, pages 697–699, and U.S. Pat. No. 3,893,899. However, problems related to the production of pure $AlCl_3$ have hitherto eliminated this process from commercial application.

Another proposal to produce aluminium in a low temperature process involved dissolving $Al_2O_3$ in an $LiCl/AlCl_3$ electrolyte to form AlOCl which was electrolyzed at approximately 700° C. However, the rate of aluminium production was too low for practical commercial application (see "Light Metal" Vol 1979, p. 356–661).

U.S. Pat. No. 4,681,671 proposed an important new principle for the production of aluminium by electrolysis of alumina dissolved in a molten fluoride-based electrolyte in an aluminium reduction cell, at a temperature below 900° C., by effecting steady-state electrolysis using an oxygen-evolving anode at an anode current density at or below a threshold value corresponding to the maximum transport rate of oxide ions in the electrolyte and at which oxide ions are discharged preferentially to fluoride ions.

That invention was based on the insight that oxide ions in low concentrations, as in the case of low temperature melts, could be discharged efficiently provided the anode current density did not exceed the given threshold. Exceeding this value would lead to the discharge of fluoride ions which had been observed in experiments using carbon anodes.

The electrolytic alumina reduction cell for carrying out the method contained a molten fluoride-based electrolyte with dissolved alumina at a temperature below 900° C., an inert oxygen-evolving anode and a cathode. The anode had an electrochemically active surface area sufficiently large to allow it to operate with an anode current density at or below the given threshold. In order to carry out stable electrolysis under the given temperature conditions and with the corresponding low solubility of alumina, the low temperature electrolyte was circulated from an electrolysis zone to an enrichment zone and back, to facilitate and speed up the solution rate of alumina.

The preferred cell design had vertical anodes in parallel spaced apart relationship above a horizontal drained cathode having holes for the upward circulation of electrolyte and through which the produced aluminium could drain to the bottom of the cell. With this design, it was proposed to lower the anode current density to values compatible with low temperature operation, usually while maintaining the cathode current density at conventional values. The aim was to maintain a satisfactory production of aluminium per unit floor surface, enabling the process to operate economically.

A proposal to implement this principle was made in U.S. Pat. No. 5,015,343, for the electrolysis of alumina in halide melts in conditions of very low solubility (<1 weight percent of alumina) which corresponds also to low temperature operation. Here, use was made of a carbon anode or a substantially non-consumable anode, whose lower surface faced a cathode pool of molten aluminium. The anode was a massive body provided with a series of vertical openings designed on the one hand, to increase the surface area of the anode and, on the other hand, for the release of the anodically evolved gas.

This design, however, suffers the serious drawback that most of the anode reaction takes place on the lower horizontal part of the anode surface, opposite the underlying cathode, which nullifies the attempt to produce an anode with a high operating surface area. A similar objection applies, to a lesser extent, to the previously mentioned cell.

With these cell designs proposed for low temperature electrolysis of alumina in a halide melt, it has not proven possible to achieve efficient electrolysis. In particular, it has not been possible with these designs to achieve the desired production per cell unit floor area in the low temperature conditions with the corresponding low solubility of alumina because of the difficulties of effectively operating the anodes over an extended surface area compared to the floor area.

With known cells and processes, virtually all materials developed for the anodes inadequately withstand the operating conditions in the agressive electrolyte at high temperature and high current density, thus providing an incentive for operation at lower temperatures.

EP-A-0 126 555 discloses an aluminium production cell with spaced monopolar anodes and cathodes joined by bolted pins. In one embodiment, the anodes and cathodes are generally vertical with slanted or inclined electrode surfaces.

U.S. Pat. No. 5,006,209 discloses an aluminium production cell with multimonopolar anodes and cathodes wherein the anodes have protruding bottom parts which generate bubbles providing a gas-lift effect in the electrolyte between the anodes and cathodes. Alumina is fed into a space outside the anodes and cathodes.

SUMMARY OF THE INVENTION

In electrolysis cells for the production of aluminium by the electrolysis of alumina dissolved in a molten salt electrolyte containing halogen compounds, the electrolyte has an electrical resistivity substantially higher than that of the anode or cathode materials utilizing carbonaceous or substantially non-consumable material made of electrically conductive material resistant to the electrolyte and to the products of electrolysis.

When operating at a temperature substantially below that of commercial Hall-Héroult cells (much below 860° C.), the solubility of alumina becomes substantially lower, therefore, requiring operation at a lower anode current density; the aluminium concentration, should be lower in order to have an effective current density substantially below that corresponding to the resulting lower limiting current density of preferential oxygen evolution. Therefore, such electrolysis cells, in order to have a productivity per unit horizontal area comparable to that of a Hall-Héroult cell, require a substantial increase of the effective active anode surface.

Such an increase can be obtained by increasing, according to the present invention, that part of the active surface area of the anode which faces the active surface area of the cathode and which is substantially parallel to such surface area. The active surface areas are positioned preferably substantially upright or at a slope so that their horizontal projected area is only a fraction of the active surface areas.

An object of the invention is thus to provide an electrolysis cell for the production of aluminium by the electrolysis of alumina dissolved in a molten salt electrolyte containing halides, preferably at a temperature below 880° C., using substantially non-consumable anodes cooperating with a cathode arrangement, wherein high cell productivity can be attained by using anodes and cathodes in a configuration enabling effective use of large anode and cathode surfaces, as described herein.

This is achieved with a design using a multimonopolar arrangement of interleaved anodes and cathodes have facing operative surfaces which are upright and are in spaced substantially parallel relationship. In other words, by making the active anode surface area substantially parallel to the active surface area of the cathode, and by positioning the anodes and cathodes upright or substantially upright, large active anode and cathode surface areas can be used and, the horizontal projected area of the anodes and cathodes on the cell floor is only a fraction of the active surface areas. This parallel multimonopolar configuration provides an optimum current distribution because of the near homogeneous electric field between the electrodes.

Previously proposed designs of multipolar cells for aluminium production by the electrolysis of alumina dissolved in a halide melt were aimed at increasing the cell productivity, over that obtainable with Hall-Héroult cells, through an increase of electrode surface area, keeping the operating current density referred to the projected surface cell floor area at the usual value of 0.5–1 A/cm$^2$. However, anode and cathode materials with acceptable technical/ecomomical characteristics are not available at present, and these cell designs remain purely conceptual.

When adopting the present invention with a vertical multipolar configuration and preferably used in a low temperature bath at 680°–880° C., use is made of the large available active electrode areas to operate at a low current density compatible with low alumina solubility, ie. below or at the threshold value for halide evolution, typically at an anode current density of 0.1 to 0.4 A/cm$^2$, while still attaining an acceptable cell productivity per cell floor surface area, comparable to that of a Hall-Héroult cell or possibly even higher.

By using facing electrodes with appropriate large surface areas, it is also possible to operate with electrolytes (fluorides or mixed fluoride-chlorides) that could not hitherto effectively be used as a carrier for alumina to be electrolyzed, on account of the low solubility.

This new arrangement has the advantage that it can make use of existing anode and cathode materials that can withstand the operating conditions at lower current densities at the same temperature (usually about 940°–960° C.) or at lower temperatures (below about 880° C.), but which failed in the more aggressive higher temperature baths at the usual high current densities necessary to achieve an acceptable production rate in the conventional cell designs.

Thus, the arrangement is particularly advantageous at lower temperatures, but can still be operated advantageously at higher temperatures, because the low current density operation enables the use of anode materials that could not withstand operation at higher current densities in high temperature molten electrolytes. By suitably lowering the anode current density and maintaining an uniform current distribution over the large anode surface area with the new cell design, many anode materials which fail at the usual high current densities (from 0.5 but usually about 1.0 A/cm$^2$ of the operative anode surface) can now perform satisfactorily at the higher temperatures if the anode current density is lowered sufficiently, possibly down to about a tenth of the values used heretofore.

Moreover, the current efficiency would be at least as high as in Hall-Héroult cells, usually higher, and the energy efficiency would be significantly improved by 20 to 30% compared to Hall-Héroult cells particularly because of the low current density and the reduced anode-cathode distance at which the multipolar cells according to the present invention can efficiently operate.

The multimonopolar arrangement of anodes and cathodes can have means for electrical connection to the anodes at the top of the cell, and means for electrical connection to the cathodes at the bottom of the cell. For instance, the bottom ends of the cathodes dip into a cathodic aluminium layer on the bottom of the cell; the cell bottom having a current collector bar or similar means for providing electrical connection of the aluminium layer to an external cathodic current supply.

The anodes and cathodes may be substantially vertical plates with the cathodes separated from the anodes by spacers of electrically non-conducting material resistant to the electrolyte and to the products of the electrolysis, which spacers also act as electrolyte guide means as explained below.

Preferably, at least the operative surfaces of the anodes and possibly also of the cathodes are high surface area structures such as porous or preferably reticulated skeletal structures. The anodes and possibly also the cathodes advantageously have a central current feeder carrying a porous active part on its opposite faces. The pore sizes of such structures may for example range from 1 to 10 mm with a porosity of from 30 to 60 vol %.

The spacing between the facing active anode and cathode surfaces is arranged to allow solely an upward circulation of electrolyte in this space by gas lift, and spaces are provided outside the multimonopolar arrangement of anodes and cathodes for downward circulation of electrolyte, and for replenishment of alumina in the electrolyte. These spaces are conveniently arranged at the side or ends of the multimonopolar arrangement of anodes and cathodes, for instance several multimonopolar arrangements of anodes and cathodes can be arranged side-by-side with the spaces therebetween. This electrolyte recirculation arrangement promotes the dissolution of alumina. To replenish the electrolyte, alumina can be fed into these spaces by any suitable means which continuously or intermittently feed metered amounts of alumina.

To enhance this electrolyte recirculation, the cell is provided with electrolyte circulation guide means adjacent the edges of the facing anodes and cathodes, formed by electrically non-conductive spacers between the edges of the facing anodes and cathodes, or by generally vertical bars of electrically non-conductive material adjacent the edges of the facing anodes and cathodes. Advantageously, the electrolyte circulation guide means comprise plates of electrically non-conductive material, possibly of alumina, arranged generally perpendicular to and on either side of the multimonopolar arrangement of anodes and cathodes.

In all of the cell designs, the total facing active surface areas of the anodes and the corresponding facing active surface areas of the cathodes is many times, preferably at least 1.5 times and possibly much greater than the horizontal projected area of the anodes and cathodes onto the cell floor area, i.e. the area of the cell bottom covered by the vertical shadow on the cell bottom of an area enclosed by a line surrounding all of the anodes and cathodes. In this way, high cell productivity per unit floor area can be achieved even at very low current densities.

The electrolyte may be a fluoride melt or a mixed fluoride-chloride melt. Suitable fluorides are NaF, $AlF_3$, $MgF_2$, LiF, KF and $CaF_2$ in suitable mixtures.

The electrolyte may comprise a mixture of 42–63 wt % $AlF_3$ with up to 48 wt % NaF, and up to 48 wt % LiF, at a temperature in the range of 680°–880° C., preferably 700°–860° C.

Another example of a fluoride-based molten salt is about 35 wt % lithium fluoride, about 45 wt % magnesium fluoride and about 20 wt % calcium fluoride, which melt has a solidus temperature of approximately 680° C.

Other examples include alkali and alkaline earth metal chlorides, and Group III metal chlorides, eg. lithium, sodium and potassium chlorides, magnesium and calcium chlorides and aluminium chloride mixed with alkali and alkaline earth metal fluorides, and Group III metal fluorides, eg. lithium, sodium and potassium fluorides, magnesium and calcium fluorides and aluminium fluorides.

Lithium-based low temperature electrolytes are advantageous because lithium penetrates carbon preferentially to sodium, thereby reducing damage by sodium intercalation. Also, the lithium may act as dopant for some ceramic oxides used as anode materials, or to prevent dissolution of a lithium dopant from a lithium-doped ceramic oxide used as anode material, and furthermore, lithium increases the electrical conductivity of the melt.

The alumina can be present in the molten salt at a concentration of about 0.1 to about 5% by weight, often from 1% to 4.5%, as compared to 10% for a standard cryolite bath at the usual Hall-Héroult operating temperature of about 960° C. Part of the alumina in the low temperature bath can be present as undissolved, solid suspension.

Mixtures of chlorides and fluorides may be advantageous to improve physical properties such as density and viscosity, and chemical reactivity. Examples of mixed fluoride-chloride baths include one or more of the fluorides of sodium, potassium, lithium, calcium and aluminium which one or more chlorides of the same elements, typically with 90–70% by weight of fluorides for 10–30% by weight of chlorides.

BRIEF DESCRIPTION OF THE DRAWINGS

The invention will now be described with reference to the accompanying schematic drawings in which.

DETAILED DESCRIPTION

Figure 1:
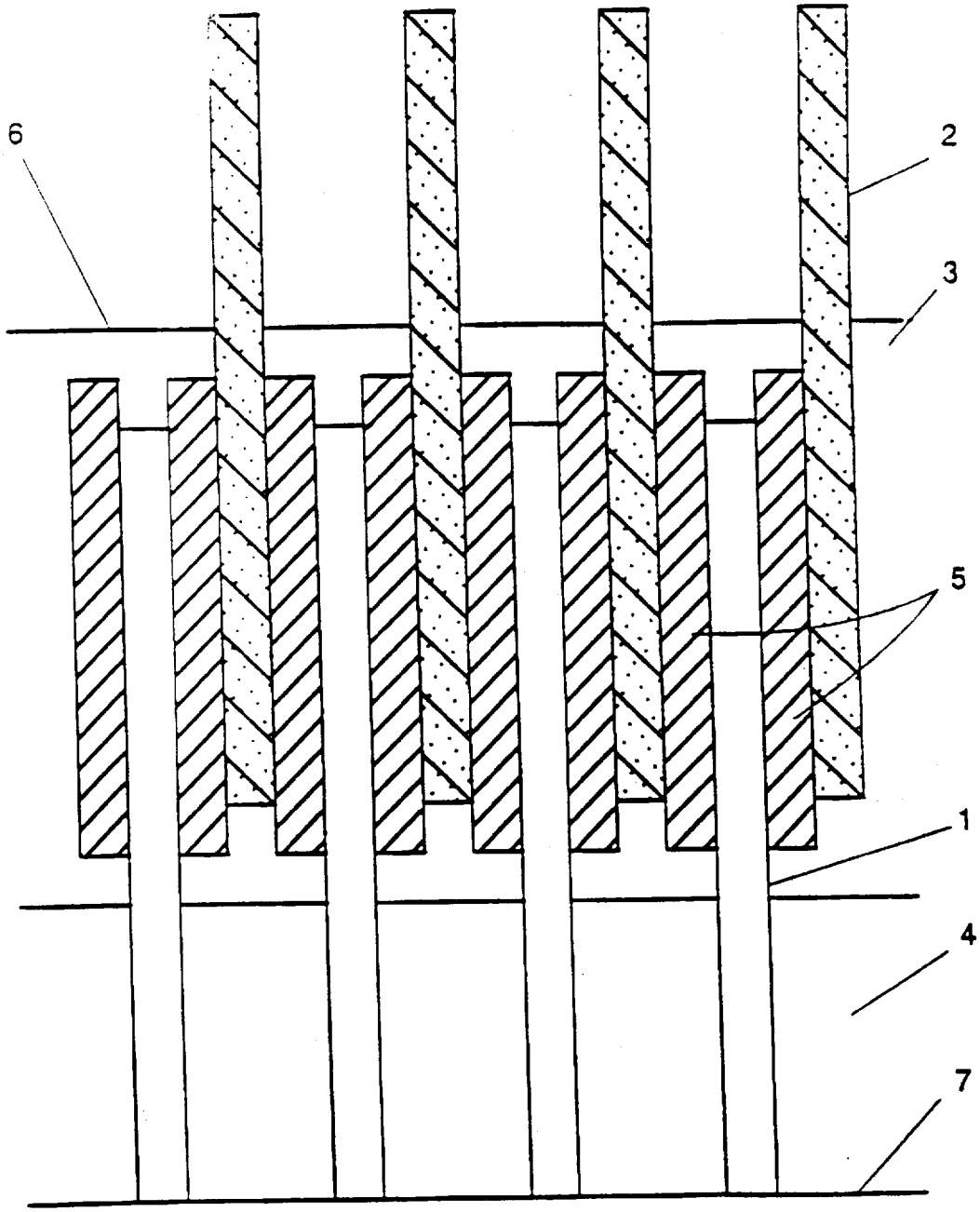
FIG. 1 is a cross-section through part of a first embodiment of a multimonopolar cell according to the invention.

FIG. 1 shows a cell design with vertical anodes and cathodes in the form of plates. In this cell, vertical cathode plates 1 and anode plates 2 are held apart in spaced parallel relationship by spacers 5. The cathode plates 1 extend downwardly from the bottom of the anode plates 2 and dip in a pool 4 of cathodic aluminium on the cell bottom 7. This cell bottom 7 contains collector bars (not shown) for the supply of current to the cathode.

The tops of the cathode plates 1 are located below the level 6 of electrolyte 3 which advantageously is one of the aforementioned halide-based electrolytes containing dissolved alumina at a temperature up to 880° C.

The anode plates 2 extend up from the top of the cathode plates 1, to above the electrolyte level 6, and are connected by any convenient means to buswork, not shown, for supplying anodic current. The level of the aluminium pool 4 may fluctuate in use, but always remains below the bottom of anode plates 2.

The spacers 5 occupy only a small part of the facing anode/cathode surfaces, leaving the main part of these facing surfaces separated by an electrolysis space containing electrolyte 3. Advantageously, the spacers 5 are located along the opposite edges of the facing anodes/cathodes. The spacers 5 can be made of any suitable electrically non-conductive material resistant to the electrolyte and to the products of electrolysis, including silicon nitride and aluminium nitride. Alumina, particularly that calcined at high temperature, can also be used, on account of the low solubility of alumina in the melt and operation with the dissolved alumina at or near saturation, with continuous or intermittent replacement of the depleted alumina.

The anode plates 2 may be made of porous, reticulated, skeletal or multicellular material, or may be ribbed, louvered or otherwise configured to increase their active surface area relative to their geometrical area. Generally, any substantially non consumable ceramic, cermet or metal can be used, possibly coated with a protective layer such as cerium oxyfluoride. The anodes can for instance be made of $SnO_2$-based materials, nickel ferrites, metals such as copper and silver or alloys such as Ni—Cu alloy or INCONEL™ (containing from 14–17 weight percent chromium, from 6–10 weight percent copper, about 0.15 weight percent carbon, about 1 weight percent manganese, about 0.5 weight percent silicon and the balance being essentially about 72 weight percent nickel and cobalt (almost completely nickel)), possibly coated with a protective coating. Composite structures can also be used, for instance a Ni—Cu alloy on a Ni—Cr substrate, or composite structures of oxidised copper/nickel on a substrate which is an alloy of chromium with nickel, copper or iron and possibly other components, as described in U.S. Pat. No. 4,960,494.

The cathode plates 1 are normally solid but porous cathode plates may also be used. The main requirement for the cathode configuration is that it should ensure homogeneous current distribution over the entire anode active surface area. Thus, in most cases, flat facing anodes and cathodes of equal sizes will be preferred.

The described cell configuration leads to a high productivity of aluminium per unit area of the cell bottom at low current densities, because large facing anode/cathode plates can be used, as more fully explained below.

Figure 2:
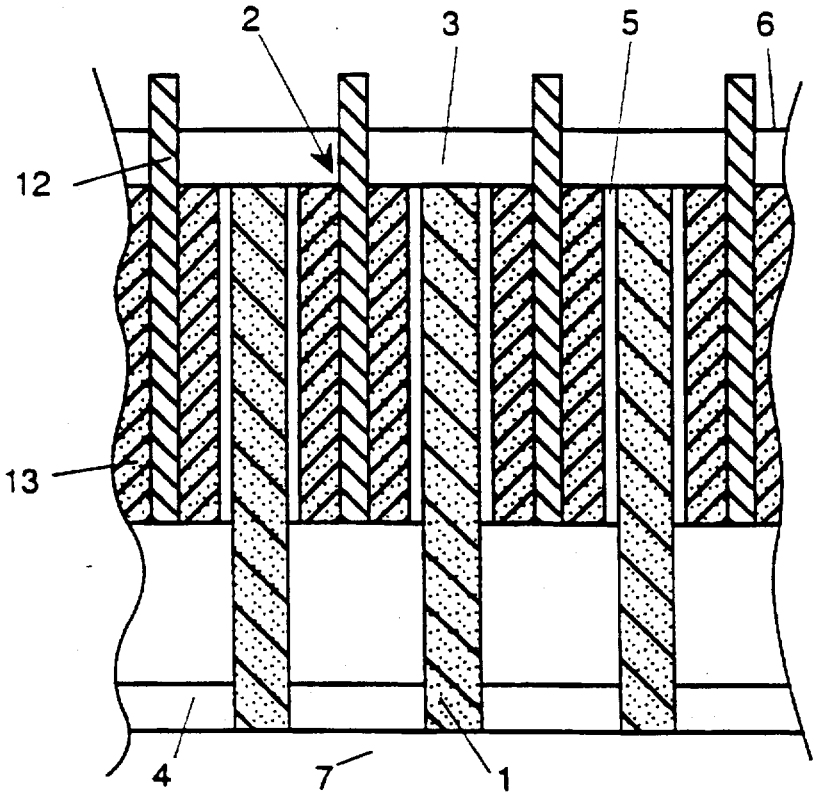
FIG. 2 is a similar view of a second embodiment of a multimonopolar cell.

FIG. 2 is a similar view of another multimonopolar cell; the same parts as before being designated by the same references. In this cell, the anodes 2 are composite structures each having a current feeder 12 made of a suitable metal alloy sandwiched between high surface area operative anode faces 13, for instance having a porous, reticulated structure.

These porous anode faces 13 can be made of or coated with a refractory oxycompound coating. For example, the current feeder 12 and the reticulated faces 13 can be made of the same or a similar metallic alloy having an excellent electrical conductivity, and the reticulated structure can be coated with a cerium oxyfluoride based protective layer applied ex situ, or formed in the cell. In this way, the resistivity of the reticulated faces 13 is closer to that of the electrolyte 3, which ensures an even current distribution throughout the structure over a high surface area, therefore, a very low effective anodic current density. The current feeder 12 of metallic alloy ensures even current distribution all over the active surface area of the anodes 2, while minimizing the voltage drop across the electrodes.

The cathodes 1 in this cell are porous bodies, for example of reticulated structure whose bottom ends dip into the cathodic aluminium pool 4 on the cell bottom 7. These porous cathode bodies can be made of or coated with an aluminium-wettable refractory hard material such as $TiB_2$. It is possible to provide the cathodes 1 with a central current feeder plate (not shown), like the anodic current feeders 12.

In use of the cells of FIGS. 1 and 2, and advantageously with the electrolyte at a temperature of 680°–880° C., electrolysis current passes between the facing operative anode and cathode surfaces which are parallel or substantially parallel surfaces arranged upright in the cell. Because of this configuration, the total operative anode and cathode surface area can be many times greater than the underlying area of the cell bottom 7. In this way, it is possible to operate the cell at comparatively low anodic current densities, compatible with the usual low operating temperatures and the corresponding low alumina solubilities, while achieving an acceptable productivity per unit floor area.

Because of the closely packed arrangement of anodes 2 and cathodes 1 necessary to achieve operation with the lowest possible voltage drop, constant circulation of the electrolyte 3 in the anode-cathode gap is necessary, especially when operating at low temperatures.

This electrolyte circulation is provided by making use of the gas lift effect. Thus, the anodically released gas (oxygen with an oxide-containing electrolyte) entrains with it an upward current of electrolyte 3 between the anodes 2 and cathodes 1. Because of the small anode-cathode gap, there is no downward circulation of electrolyte in the anode-cathode gap. In the cell housing, on either side of the anodes 2 and cathodes 1, a space is left for downward recirculation of the electrolyte 3. Fresh alumina can be supplied to these spaces to compensate for depletion during electrolysis. The high electrolyte circulation rate promoted by gas lift enhances the rate of alumina dissolution, compared to conventional cells.

Figure 3:
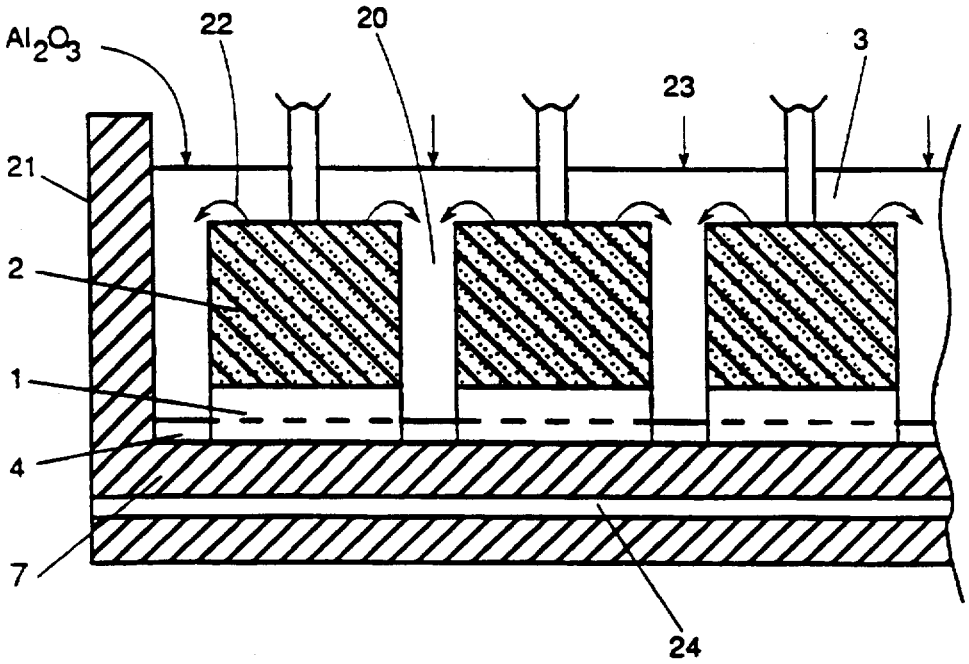
FIG. 3 illustrates a possible arrangement of the cells of FIGS. 1 and 2 to provide for electrolyte circulation and alumina replenishment.

Such an arrangement, illustrated schematically in FIG. 3 for cells of the type shown in FIGS. 1 and 2, may have several multimonopolar rows of anodes 2 and cathodes 1 spaced across the width or along the length of the cell, with a space 20 between the adjacent rows and also adjacent the sidewalls 21 of the cell. Alternatively, the cell could have a single row of multimonopolar anodes and cathodes along its length, with recirculation spaces on either side and/or at the ends of the cell.

By the gas-lift effect, electrolyte 3 is circulated as indicated by arrows 22 up between the opposite active surfaces of the anodes 2 and cathodes 1, and down in the spaces 20. If required, the gas lift effect can be assisted by forced circulation using a pump made of alumina or other electrolyte-resistant material.

Alumina is fed to the spaces 20 as indicated by arrows 23 at a rate to compensate for depletion during electrolysis. This rate can be calculated from the cell's current consumption and can, if necessary, be monitored by measuring the alumina concentration of the cell periodically, for instance by the method disclosed in European Patent Application 468092.

In the schematic illustration of FIG. 3, current is supplied to the conductive cell bottom 7 by a cathodic current feeder 23. However, other arrangements are possible.

The anodes 2 can if required be provided with vertical grooves or ribs to assist the gas release.

Circulation of the electrolyte is enhanced by circulation guide means, possibly formed by the spacers 5, adjacent the edges of the facing anodes and cathodes of each multimonopolar stack, as illustrated in FIGS. 4 to 7.

Figure 4:
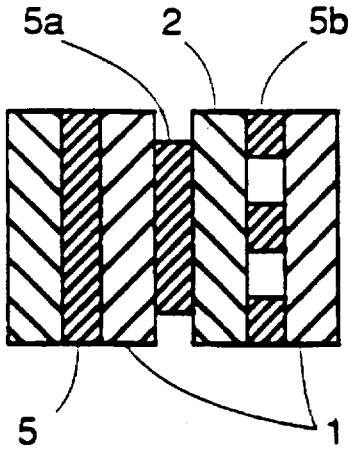
FIG. 4 is a schematic side elevation showing different forms of spacers arranged to promote electrolyte re-circulation.
Figure 5:
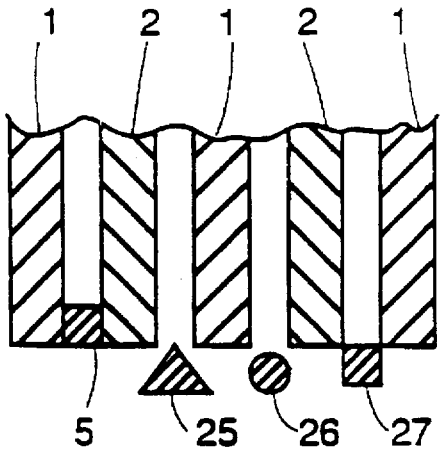
FIG. 5 is a schematic plan view showing different forms of members arranged to promote electrolyte re-circulation.

FIG. 4 shows in side view several possible forms of spacers: spacer 5 extends over the entire height of the anodes/cathodes; spacer 5*a* extends over a major part of the height, to near the top and bottom of the anodes/cathodes 1, 2; and spacers 5*b* are spaced apart from one another over the height of the anodes/cathodes 1, 2. The plan view of FIG. 5 shows how these spacers 5 are located between the anodes 2 and cathodes 1 adjacent their edge. Thus, with this arrangement, the facing electrodes 1, 2 are enclosed at their sides like a box, forcing the electrolyte flow up inside, and down outside. When discontinuous spacers like 5*b* are provided, this allows for some electrolyte intake from the sides.

FIG. 5 also shows alternative electrolyte guides which do not act as spacers, namely generally vertical bars 25 of triangular section, bars 26 of circular section and bars 27 of square or rectangular section. These pars are placed outside the anode-cathode space, allowing maximum use of the facing electrode surfaces. As shown for 25 and 26, the bars can be spaced from the edges of the facing electrodes 1, 2 to allow controlled intake of electrolyte from outside. Or, as shown for the rectangular bar 27, the bars can contact the edges of the facing electrodes 1, 2 to close the sides of the multimonopolar stack. As for the spacers 5, these bars 25, 26, 27 can extend over the entire height of the electrodes 1, 2, or only a part of the height.

Figure 6:
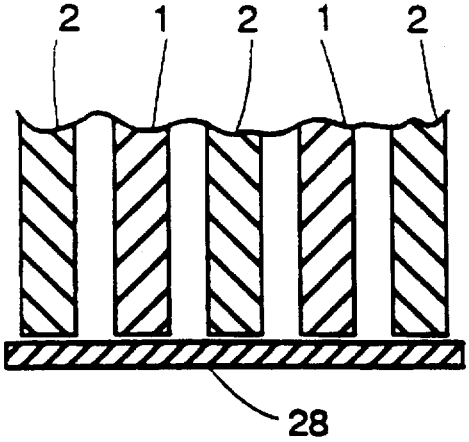
FIG. 6 is a schematic plan view showing another arrangement for promoting electrolyte re-circulation.
Figure 7:
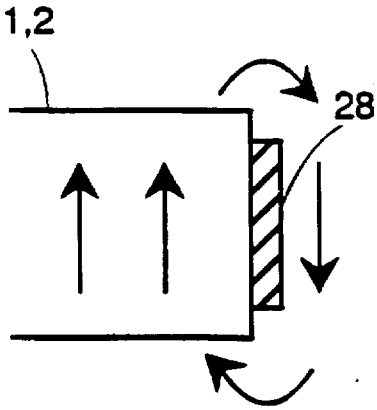
FIG. 7 is a schematic illustration of the electrolyte circulation with the arrangement of FIG. 6.

FIGS. 6 and 7 show another arrangement for controlling the electrolyte flow path, namely plates 28 extending along each side of each multimonopolar stack of electrodes 1, 2 over their entire height or, as shown in FIG. 7, over the major part of their height to just below the top and just above the bottom of the stack. These plates 28 can contact the edges of the electrodes 1, 2 or can be spaced apart by a convenient distance. FIG. 7 shows the upward electrolyte flow between the electrodes 1, 2 and the downward flow outside the stack, as well as the alumina feed 23.

The bars 25, 26, 27 and plates 28 can all be made of the same electrically-resistant non-conductive materials as the spacers 5. By making the bars 25, 26, 27 and the plates 28 of alumina, which slowly dissolves in the molten electrolyte, this dissolution contributes to the alumina feed and the bars/plates can be replaced when necessary.

The feasibility of a multipolar cell according to the invention is further illustrated in the following examples.

EXAMPLE I

An experiment was conducted in a laboratory scale electrolytic cell composed of an alumina crucible containing two copper sheet anodes measuring approximately 100×100×1 mm vertically facing opposite sides of a block cathode of graphite measuring approximately 100×100×8 mm. These electrodes were immersed in an electrolyte composed of 63% $Na_3AlF_6$ (cryolite) and 37% $AlF_3$, by weight, saturated with alumina. The electrolyte temperature was 750° C.; the alumina solubility was approximately 4% by weight of the electrolyte. Excess alumina powder was present in the cell, outside the anode-cathode gap.

The gaps between the large faces of the anodes and cathode were 6 mm. Current was supplied at an anode and an equal cathode current density of 0.2 A/cm$^2$; this current flowing uniformly over the entire surfaces of the facing anodes and cathode. The cell voltage was approximately 3.2 V. The gas lift during electrolysis was sufficient to circulate electroyte upwardly in the anode-cathode gaps, the electrolyte flowing down outside the electrodes. Alumina powder was added outside the electrode during operation to maintain the alumina concentration in the anode-cathode gaps. Electrolysis was continued for 200 hours. The current efficiency was >90%. This experiment demonstrates the advantages of facing vertical anode and cathode plates in a basic multimonopolar unit, which readily can be scaled up by multiplying the number of units and their sizes.

EXAMPLE II

A second experiment using the cell design shown in FIG. 1 was carried out in a laboratory cell consisting of an alumina crucible of 12 cm internal diameter heated in an electrical resistance furnace.

Two plates of titanium diboride of 80 mm length, 50 mm width and 5 mm thickness were used as vertical cathodes. Three plates of tin oxide of 120 mm length, 50 mm width and 5 mm thickness were used as vertical anodes. Anodes and cathodes were held together at a 5 mm interelectrode distance by means of two alumina plates 60 mm high, 55 mm wide and 10 mm thick, each fitted with five vertical grooves into which the vertical edges of the cathodes and anodes were lodged. The lower end of the cathodes rested on the crucible bottom and were dipping in a molten aluminum pad of 1 cm thickness which acted as the cathode current collector. The upper parts of the anodes were held together by means of an INCONEL 600™ block bolted to the anodes and which also served as the anode electrical contact and mechanical support.

The nominal electrolyte composition was 63% $Na_3AlF_6$ (cryolite) and 37% $AlF_3$ by weight saturated with alumina. The electrolyte temperature was 750° C. The alumina solubility was approximately 4% by weight of the electrolyte.

The electrochemically active surface area of each anode and cathode face was 21.50 cm$^2$ and the total active surface was 86 cm$^2$. The vertically projected surface area of the anode-cathode assembly was approximately 23 cm$^2$.

Current was supplied to the anodes and cathodes at an equal current density of 0.2 A/cm$^2$ corresponding to a total voltage of approximately 3.8 V. This corresponds to a current density of 0.76 A/cm$^2$ over the projected area of the cell bottom, which is equivalent to that in conventional Hall-Héroult cells. The productivity of the cell per unit projected area of the cell bottom is, therefore, also equivalent to that in conventional Hall-Héroult cells.

Efficient electrolyte circulation between the anodes and cathodes was achieved by the gas lift due to the oxygen evolution at the surface of the anodes. This effect was demonstrated by the fact that alumina powder feed was added outside the electrode system without significant drop in alumina concentration in the electrode gaps as evidenced by a stable voltage during the electrolysis. The electrolysis was continued for 100 hours. The current efficiency was about 88%. The cathodes after the experiment were completely wetted by aluminum indicating that the metal was drained from the cathode to the bottom of the cell. The relatively high current efficiency shows that no significant aluminum reoxidation by the evolving oxygen did occur.

This experiment demonstrates the feasibility of operating a vertical multimonopolar anode and cathode assembly at a low current density while maintaining a cell productivity equivalent to a conventional Hall-Héroult cell. Another significant advantage is the considerably increased electrolyte circulation achieved with the proposed design which allows for efficient feeding in an enrichment zone outside the anode-cathode assembly.

We claim:

1. An electrolysis cell having a top and a bottom, for the production of aluminium by the electrolysis of alumina dissolved in a molten salt electrolyte containing halides using substantially non-consumable anodes cooperating with a cathode arrangement in a multimonopolar arrangement of interleaved anodes and cathodes, said anodes and cathodes having sides and ends, said anodes and cathodes also having facing operative surfaces which are upright and in spaced substantially parallel relationship, wherein the spacing between the facing active anode and cathode surfaces is arranged for upward circulation of electrolyte by gas lift, and wherein spaces are provided outside the multipolar arrangement of anodes and cathodes for downward circulation of electrolyte and for replenishment of alumina in the electrolyte, comprising:

members of electrically non-conducting material arranged adjacent the edges of the facing anodes, to form electrolyte circulation guide means.

2. An aluminium production cell according to claim 1, wherein the multimonopolar arrangement of anodes and cathodes has means for electrical connection to the anodes (1) at the top of the cell, and means for electrical connection to the cathodes (1) at the bottom of the cell.

3. An aluminium production cell according to claim 2, wherein the cathodes dip into a cathodic aluminium layer on the bottom of the cell, the cell bottom having means for providing electrical connection of the aluminium layer to an external current supply.

4. An aluminium production cell according to claim 2 or 3, wherein at least the operative surfaces of the anodes, the cathodes or the cathodes and the anodes are high surface area structures.

5. An aluminium production cell according to claim 4, wherein the anodes, the cathodes or the anodes and cathodes have a central current feeder and a porous active part (13) on opposite faces of said central current feeder.

6. The aluminium production cell of claim 4, wherein said high surface area structures are porous.

7. The aluminium production cell of claim 6, wherein said high surface area structures are reticulated skeletal structures.

8. An aluminium production cell according to claim 1, wherein said spaces are arranged at the sides or ends of the multimonopolar arrangement of anodes and cathodes.

9. An aluminium production cell according to claim 1, wherein several multimonopolar arrangements of anodes and cathodes are arranged side-by-side with the spaces therebetween.

10. An aluminium production cell according to claim 1, comprising means for feeding alumina into the spaces to replenish the electrolyte with alumina.

11. An aluminium production cell according to claim 1, wherein the electrolyte circulation guide means comprise generally vertical bars of electrically non-conductive material adjacent the edges of the facing anodes and cathodes.

12. An aluminium production cell according to claim 1, wherein the electrolyte circulation guide means comprise at least one plate of electrically non-conductive material generally perpendicular to and on either side of the multimonopolar arrangement of anodes and cathodes.

13. An aluminium production cell according to claim 1, wherein the active anode surface have an area which is greater than the area of the facing active cathode surface.

14. An aluminium cell according to claim 1, wherein the electrolyte is a fluoride melt, or a mixed fluoride-chloride melt.

15. The cell of claim 14, wherein the electrolyte is a mixture of $AlF_3$ with at least one of NaF and LiF, comprising 42–63 weight % of $AlF_3$, up to 48 weight % of NaF and up to 48 weight % of LiF.

16. The cell of claim 14, wherein the electrolyte is a mixed fluoride-chloride electrolyte comprising 90–70% by weight of one of more fluorides of sodium, potassium, lithium, calcium and aluminium with 10–30% by weight of one or more chlorides of sodium, potassium, lithium, calcium and aluminium.

17. The cell of claim 1 wherein each said anode and said cathode have a total facing active surface area and a horizontal projected area, wherein the total facing active surface areas of the anodes and cathodes are substantially equal and are each at least 1.5 times the horizontal projected area of the anodes and cathodes on the cell bottom.

18. The cell of claim 17 wherein the total facing active surface areas of the anodes and the cathodes are greater than or equal to 4 times the horizontal projected area of the anodes and cathodes on the cell bottom.

19. An electrolysis cell having a top and a bottom, for the production of aluminium by the electrolysis of alumina dissolved in a molten salt electrolyte containing halides using substantially non-consumable anodes cooperating with a cathode arrangement in a multimonopolar arrangement of interleaved anodes and cathodes, said anodes and cathodes having sides and ends, said anodes and cathodes also having facing operative surface which are upright and in spaced substantially parallel relationship wherein the spacing between the facing active anode and cathode surfaces is arranged for upward circulation of electrolyte by gas lift, and wherein spaces are provided outside the multimonopolar arrangement of anodes and cathodes for downward circulation of electrolyte and for replenishment of alumina in the electrolyte, said cell also comprising members arranged outside said spacing, to form electrolyte circulation guide means, wherein the electrolyte in said cell is maintained at an operating temperature in the range 680°–880° C.

20. The cell of claim 19 wherein current is supplied to the active anode surfaces at an anode current density below or at the threshold value for halide evolution.

21. The cell of claim 19, wherein the anode current density is from 0.1 to 0.4 $A/cm^2$ per unit area of the active anode surface area.

* * * * *